US005527160A

United States Patent [19]

Kozumplik, Jr. et al.

[11] Patent Number: 5,527,160

[45] Date of Patent: Jun. 18, 1996

[54] MECHANICAL SHIFT, PNEUMATIC ASSIST PILOT VALVE

[75] Inventors: Nicholas Kozumplik, Jr., Bryan; Richard K. Gardner, Montpelier, both of Ohio

[73] Assignee: The Aro Corporation, Bryan, Ohio

[21] Appl. No.: 320,811

[22] Filed: Oct. 11, 1994

[51] Int. Cl.[6] ..... F04B 49/00; F04B 43/10; F04B 43/06

[52] U.S. Cl. ..... 417/46; 417/393; 417/395; 251/31; 91/313

[58] Field of Search ..... 417/46, 393, 395; 251/25, 28, 31; 91/313, 329

[56] References Cited

U.S. PATENT DOCUMENTS

| | | | |
|---|---|---|---|
| 3,838,946 | 10/1974 | Schall | 417/395 |
| 4,854,832 | 8/1989 | Gardner et al. | 417/393 |
| 5,232,352 | 8/1993 | Robinson | 417/393 |
| 5,277,555 | 1/1994 | Robinson | 417/393 |

*Primary Examiner*—Richard A. Berisch
*Assistant Examiner*—Xuan M. Thai
*Attorney, Agent, or Firm*—Walter C. Vliet

[57] ABSTRACT

A pneumatic assist valve receives constant air pressure from supply air to provide the pneumatic assist to shift the pilot, eliminating false signals acting on the trip rod and the design also assures the pilot has completely shifted before diaphragm reversal occurs.

10 Claims, 4 Drawing Sheets

MECHANICAL SHIFT, PNEUMATIC ASSIST PILOT VALVE

BACKGROUND OF THE INVENTION

This invention relates generally to mechanical shift, pneumatic assist valves and more particularly to a mechanical shift pneumatic assist valve for diaphragm pumps which use a separate pilot valve to provide a positive signal (either on or off to the major air distribution valve).

Disclosed is an improvement of the device described in U.S. Pat. No. 4,854,832 assigned to The Aro Corporation. The prior art device significantly reduced the possibility of motor stall by providing a positive signal (either on or off) to the major air distribution valve. This was accomplished by adding a separate valve (pilot) which was not connected to the diaphragm rod. Actuation of the valve was accomplished by mechanically pushing the valve to the trip point with the diaphragm washer attached to the diaphragm connecting rod causing the major valve to shift. As pressure built up in the diaphragm air chamber it also acts on the end of the pilot rod (area) and forced it to end of its stroke. Air pressure holds it in this position until the diaphragm washer pushes it in the opposite direction. As long as the pilot rod was in either extreme position, a signal is always present to the major valve.

Other designs which incorporate the 'pilot' on the diaphragm connecting rod, shut the signal off to the major valve after the diaphragm changes direction.

Occasionally an air pressure spike occurs in the diaphragm air chamber which is being exhausted. The spike occurs when there is an unusually rapid reversal of the diaphragms due to malfunctioning check valves or large volume of air trapped in one or both air caps or a restriction in the exhaust. If this pressure spike exceeds the pressure of the incoming air of the chamber being pressurized to pneumatically assist the trip rod, the spike can cause the trip rod to back up. Depending on the pump speed, operating pressure and severity of any one of the above conditions, the pump may begin to rapidly short stroke because the trip rod is oscillating back and forth around the trip point and out of sync with the diaphragm rod. Occasionally this condition results in a motor stall.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a mechanical shift pneumatic assisted pilot valve for a reciprocating function comprising a reciprocating piston disposed in a bore intermediate a first and a second reciprocating element and being provided with a means at one end for directly contacting the first reciprocating element in one operating position and a pneumatic piston at another end, the pneumatic piston being further provided with a means for contacting the second reciprocating element in a second operating position; and the pneumatic piston being a stepped piston having a lesser diameter constantly pressurized in one biasing direction and a greater diameter alternately pressurized in an opposite biasing direction in response to mechanical shift of the pneumatic piston effected by the means for contacting the second reciprocating element, the mechanical shift further effecting reversal of direction of the first and second reciprocating elements.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
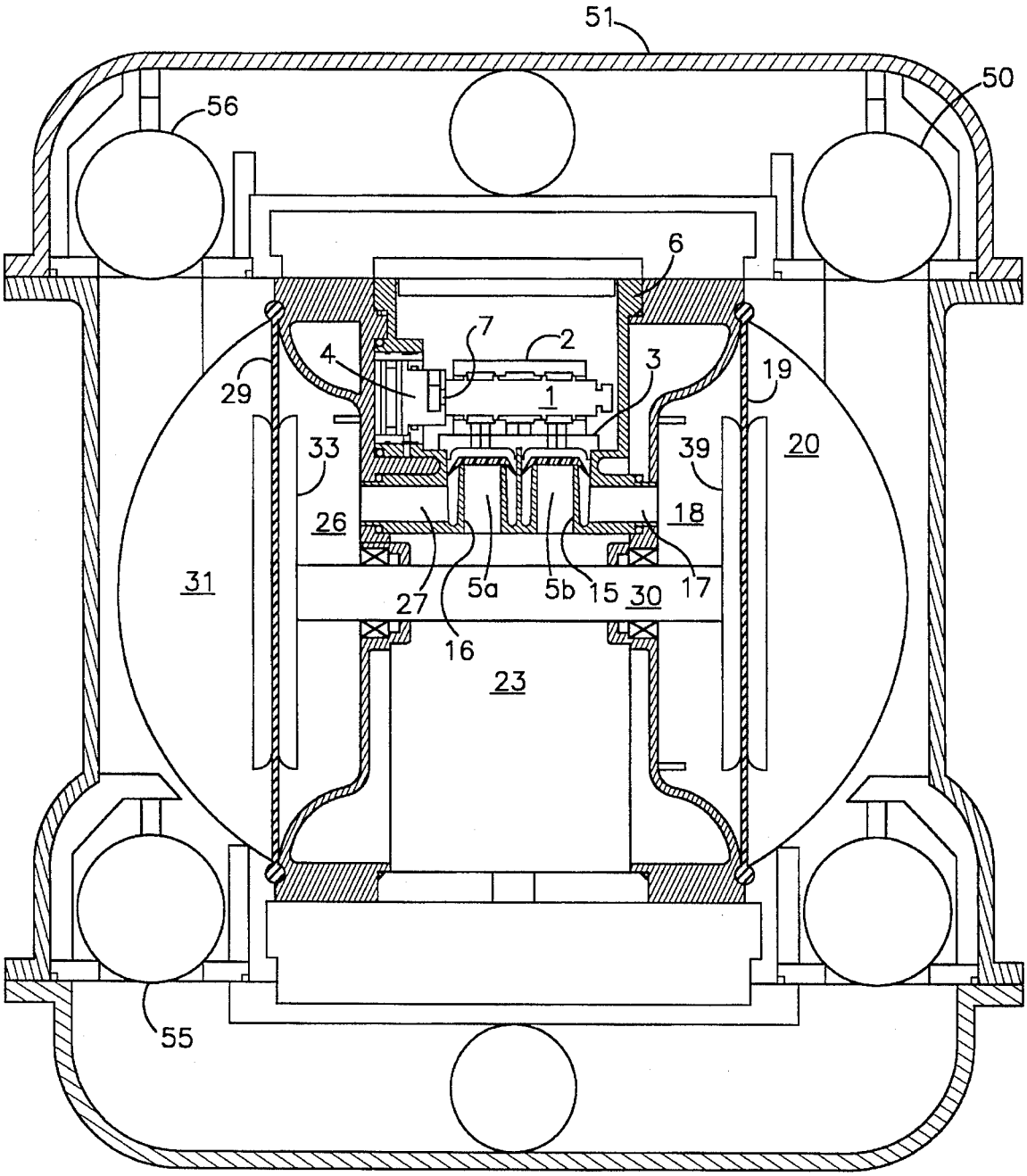
FIG. 1 is a cross section of a diaphragm pump showing an air motor major valve according to the present invention.
Figure 2:
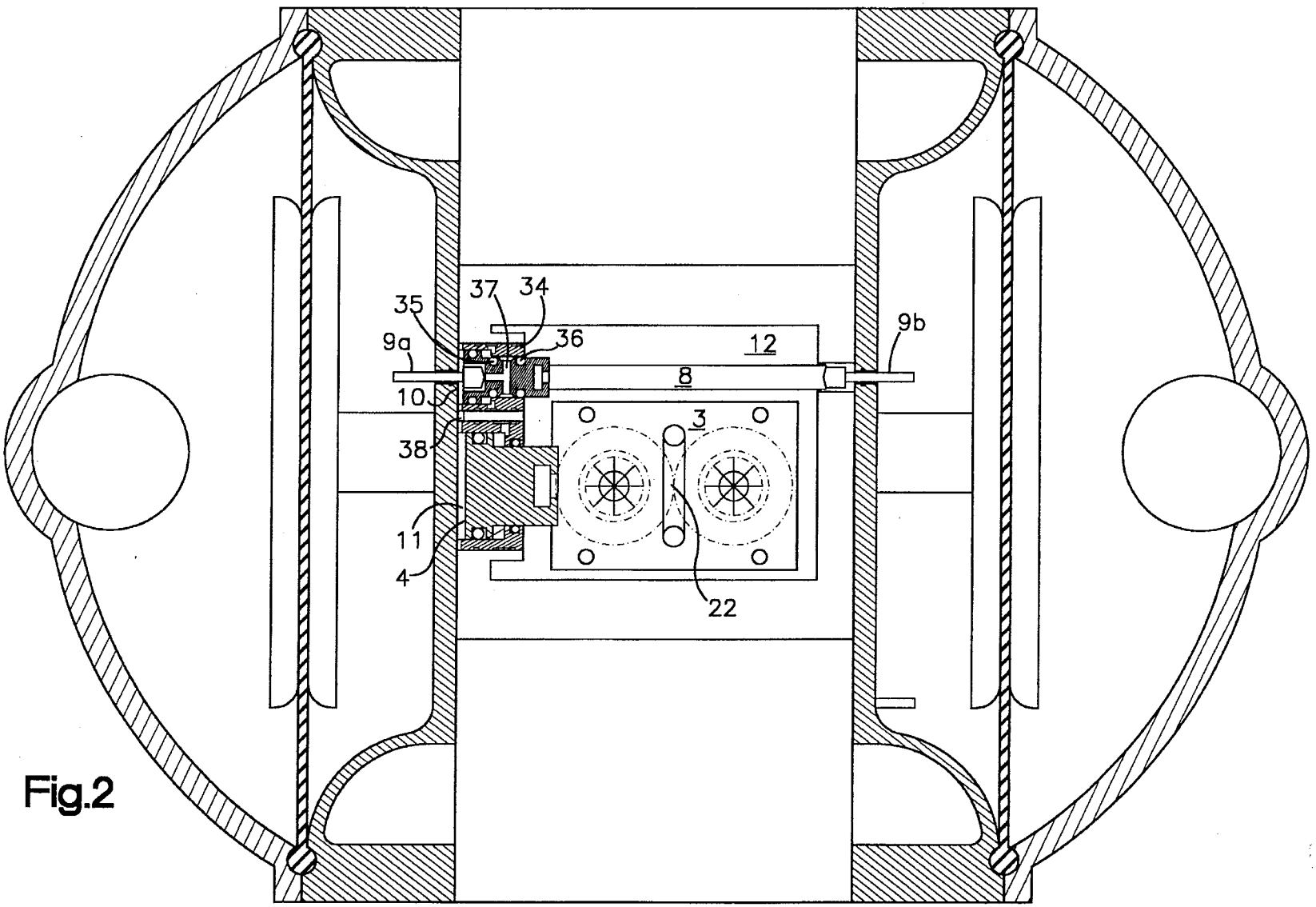
FIG. 2 is a cross section of an improved mechanical shift, pneumatic assist pilot valve according to the present invention showing the pilot valve.

FIG. 1 is a cross sectional view of the air motor major valve. FIG. 2 is a view of the pilot valve. Both valves are shown in dead center position.

Figure 5:
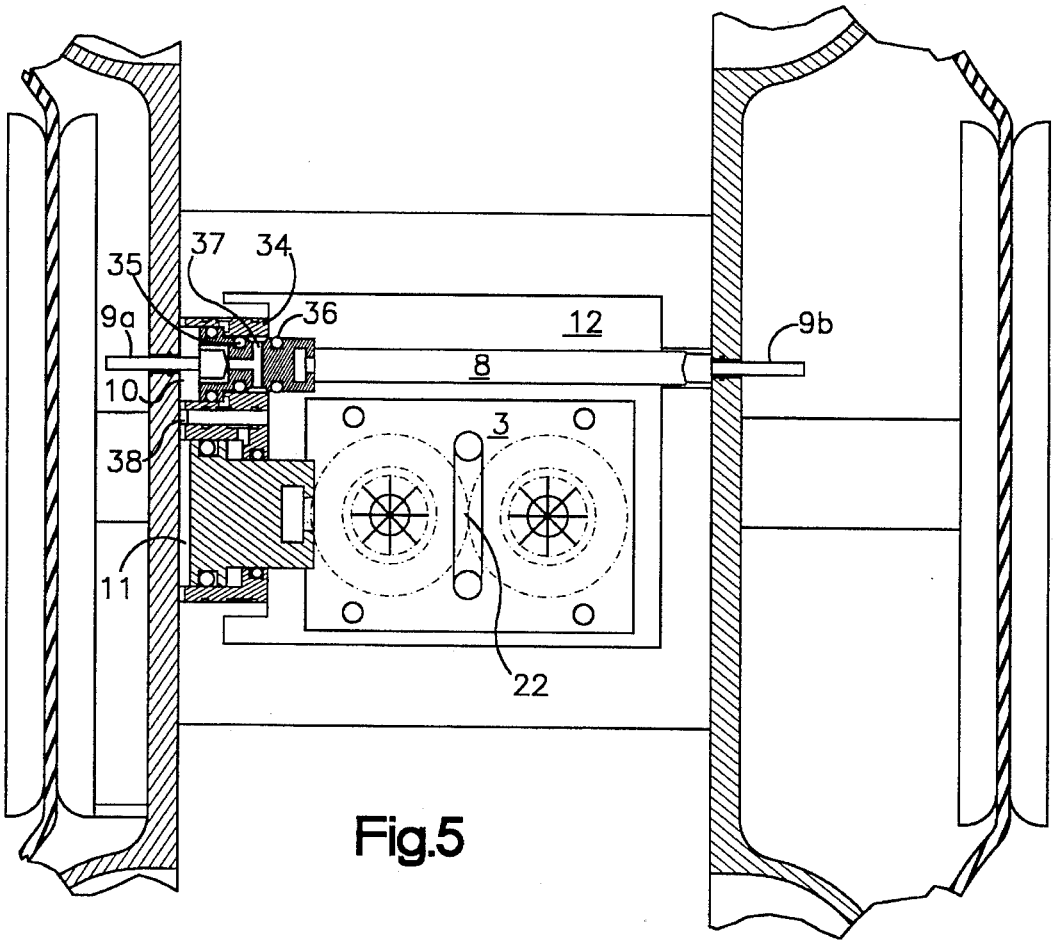
FIG. 5 is a cross section detail showing the pilot valve in the extreme right hand position.
Figure 6:
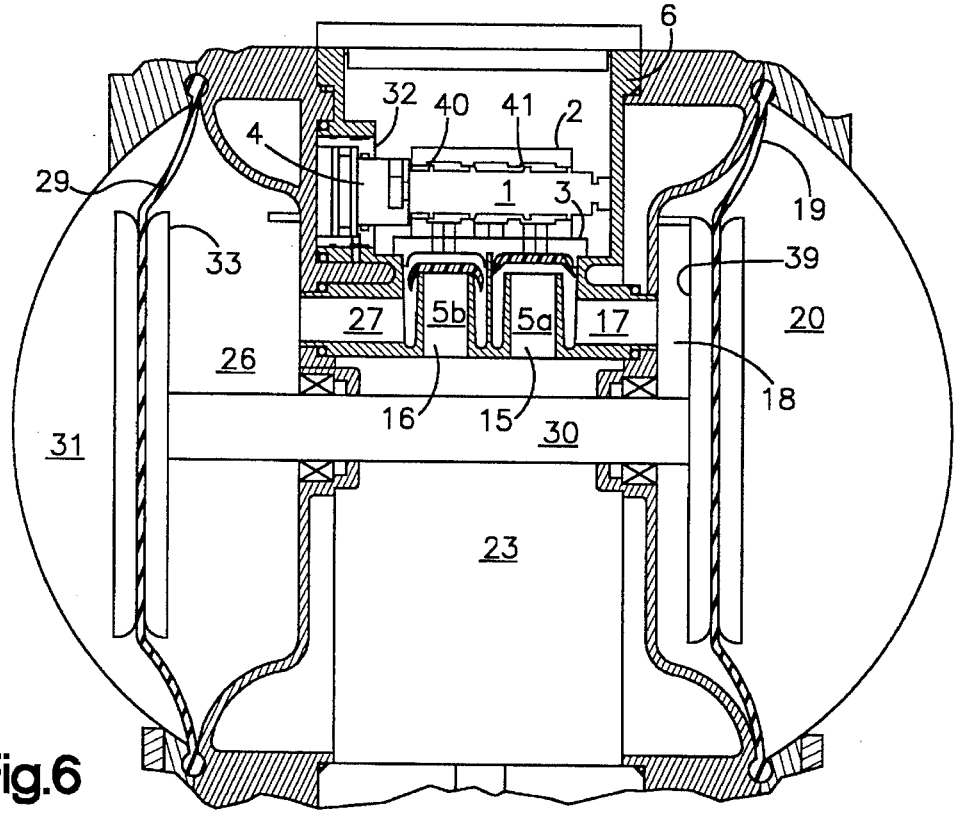
FIG. 6 is a cross section detail showing the major valve in the extreme right hand position.

In FIG. 1 the major valve consists of a spool 1, valve block 2, valve plate 3, power piston 4, quick dump valves **5*a* and 5*b* and housing 6. FIG. 2 shows the pilot valve according to the present invention consisting of pilot piston 7, pushrod 8 and actuator pins 9*a* and 9*b*. Both valves are located in the same cavity 12 which is pressurized with supply air. The power piston 4 and pilot piston 7 are differential pistons. Air pressure acting on the small diameters of the pistons will force the pistons to the left when pilot signal is not present in chambers 10 and 11. The area ratio from the large diameter to the small diameter is approximately 2:1. When the pilot signal is present in chambers 10 and 11 the pistons are forced to the right as shown in FIGS. 5 and 6**.

Figure 3:
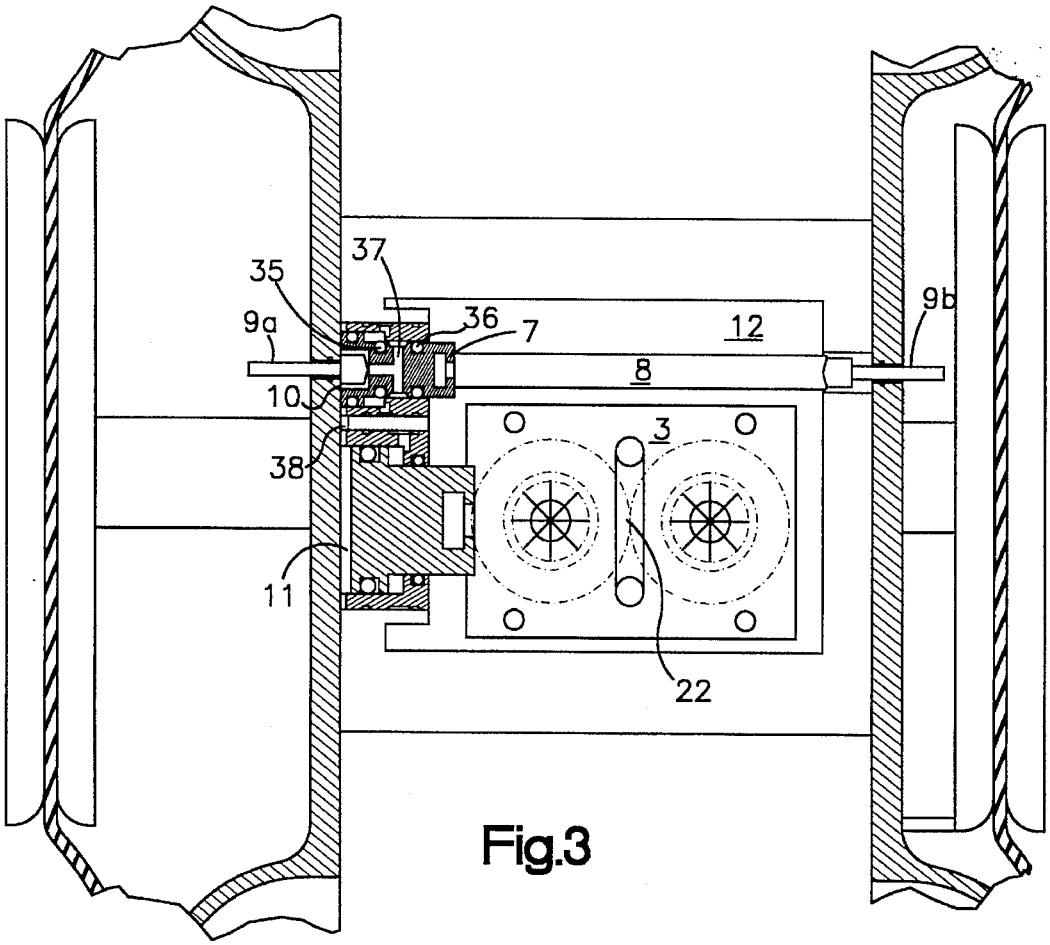
FIG. 3 is a cross section detail showing the pilot valve according to the present invention in the extreme left position.
Figure 4:
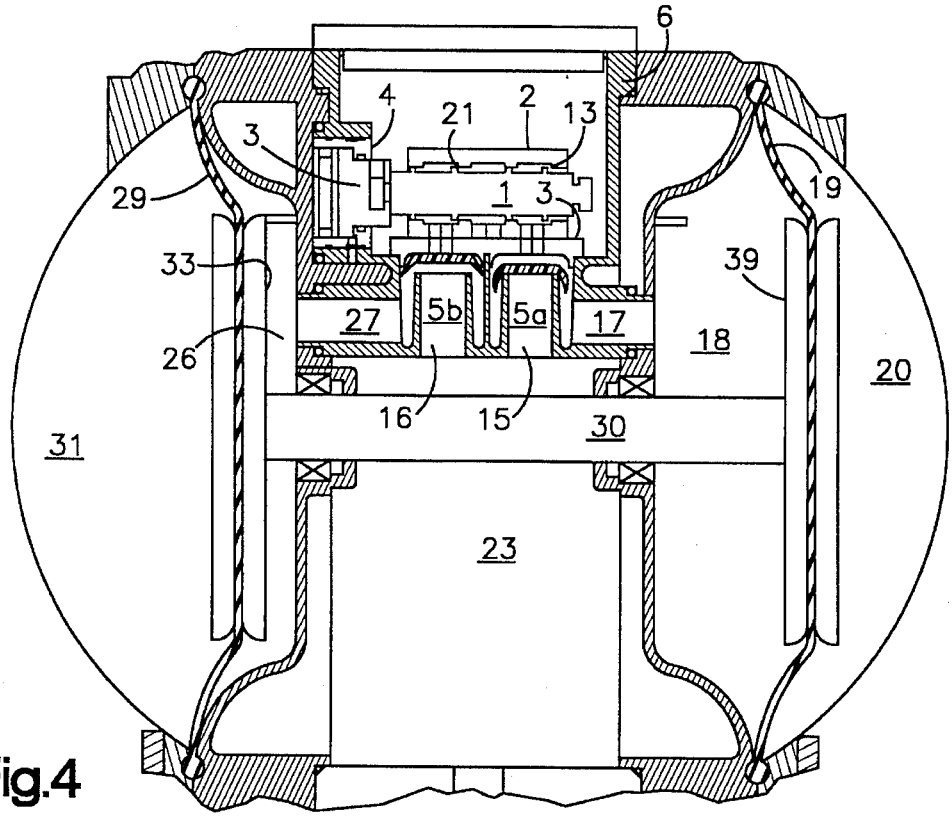
FIG. 4 is a cross section detail showing the air motor major valve spool in the extreme left hand position.

In FIG. 4 the spool 1 of the main valve is shown in its extreme left position as is pilot piston 7 in FIG. 3. Air in cavity 12 flows through orifice 13 created between spool 1 and valve block 2 through port 14 in valve plate 3. The air impinging on the upper surface of check **5*a* forces it to seat and seal off exhaust port 15. The air flow deforms the lips of the elastomeric check as shown in FIG. 4. Air flows around the check into port 17 and into diaphragm chamber 18. Air pressure acting on the diaphragm 19 forces it to the right expelling fluid from the fluid chamber 20 through an outlet check valve 50 (see FIG. 1**).

Operation of the fluid check valves control movement of fluid in and out of the fluid chambers causing them to function as single acting pumps. By connecting the two chambers through external manifolds 51 output flow from the pump becomes relatively constant.

At the same time chamber 18 is filling, the air above check **5*b* has been exhausted through orifice 21, port 22 and into exhaust cavity 23. This action causes a pressure differential to occur between chambers 24 and 25. The lips of valve 5*b* relax against the wall of chamber 25. As air begins to flow from air chamber 26 through port 27, it forces check 5*b* to move upward and seats against valve plate 3 and seal off port 28 and opens port 16. Exhaust air is dumped into cavity 23**.

Diaphragm 19 is connected to diaphragm 29 through shaft 30 which causes them to reciprocate together. As diaphragm 19 traverses to the right diaphragm 29 evacuates fluid chamber 31 which causes fluid to flow into fluid chamber 31 through an inlet check 55. As the diaphragm assembly approaches the end of the stroke, diaphragm washer 33 pushes actuator pin 9*a* to the right. The pin in turn pushes pilot piston 7 to the right to the position shown in FIG. 5. O-ring 35 is engaged in bore of sleeve 34 and O-ring 36 exits the bore to allow air to flow from air cavity 12 through port 37 in pilot piston 7 and into cavity 10. Air pressure acting on the large diameter of pilot piston 7 causes the piston to shift to the right.

The air that flows into chamber 10 also flows into chamber 11 through passage 38 which connects the two bores. When the pressure reaches approximately 50% of supply pressure, the power piston 4 shifts spool 1 to the position shown in FIG. 6. Air being supplied to chamber 18 is shut off and chamber 38 is exhausted through orifice 41. This causes check 5*a* to shift connecting air chamber 18 to exhaust port 15. At the same time air chamber 26 is connected to supply air through orifice 40 and port 28 and 27. The air pressure acting on diaphragm 29 causes the diaphragms to reverse direction expelling fluid from fluid chamber 31 through the outlet check 56 while diaphragm 19 evacuates fluid chamber 20 to draw fluid into fluid chamber 20.

As diaphragm 19 approaches the end of its stroke, diaphragm washer 39 pushes actuator pin 9*b*. The motion is transmitted through pushrod 8 to pilot piston 7 moving it to the trip point shown in FIG. 2. O-ring 36 reenters the bore in sleeve 34 and seals off the air supply to chambers 10 and 11. O-ring 35 exits the bore to connect chambers 10 and 11 to port 37 in pilot piston 7. The air from the two chambers flows through port 42 into exhaust cavity 23. Air in air cavity 12 acting on the small diameters of pistons 4 and 7 forces both to the left as shown in FIG. 3. The power piston 4 will pull spool 1 to the left to begin a new cycle as shown in FIG. 4.

Having described our invention in terms of a preferred embodiment, we do not wish to be limited in the scope of our invention except as claimed.

What is claimed is:

1. A mechanical shift pneumatic assisted pilot valve for a reciprocating function comprising:

a reciprocating piston disposed in a bore intermediate a first and a second reciprocating element and being provided with a means at one end for directly contacting said first reciprocating element in one operating position and a pneumatic piston at another end, said pneumatic piston being further provided with a means for contacting said second reciprocating element in a second operating position; and said pneumatic piston being a stepped piston having a lesser diameter constantly pressurized in one biasing direction and a greater diameter alternately pressurized in an opposite biasing direction in response to mechanical shift of said pneumatic piston effected by said means for contacting said second reciprocating element, said mechanical shift further effecting reversal of direction of said first and second reciprocating elements.

2. A mechanical shift pneumatic assisted pilot valve for a reciprocating function according to claim 1 wherein: said first and second reciprocating elements further comprise pumping elements.

3. A mechanical shift pneumatic assisted pilot valve for a reciprocating function according to claim 1 wherein: said pumping elements comprise pump diaphragms.

4. A mechanical shift pneumatic assisted pilot valve for a reciprocating function according to claim 1 wherein: said means at one end for directly contacting said first reciprocating element in one operating position comprises a contact pin of minimum structural diameter projecting into a pressurized operating cavity of a pumping element so as to minimize the cavity pressure effect on said contact pin and said reciprocating piston.

5. A mechanical shift pneumatic assisted pilot valve for a reciprocating function according to claim 1 wherein: said means for directly contacting said second reciprocating element in a second operating position comprises a second contact pin of minimum structural diameter projecting into a pressurized operating cavity of a pumping element thereby minimizing the cavity pressure effect on said second contact pin and said pneumatic piston.

6. A mechanical shift pneumatic assisted pilot valve for a reciprocating function according to claim 1 wherein: said pneumatic piston further comprises a stepped piston having a greater diameter face alternately exposed to pressure fluid to effect longitudinal translation of said pneumatic piston in response to said pneumatic piston being displaced by said second contact pin in a longitudinal direction.

7. A mechanical shift pneumatic assisted pilot valve for a reciprocating function according to claim 6 wherein: said pneumatic piston is disposed in a stepped bore having a major diameter and a minor diameter corresponding to and cooperating with a major diameter and a minor diameter of said pneumatic piston.

8. A mechanical shift pneumatic assisted pilot valve for a reciprocating function according to claim 7 wherein: said stepped bore is sealed at its said major diameter end, open to a constant source of pressure fluid at its minor diameter end, and vented intermediate its major and minor ends.

9. A mechanical shift pneumatic assisted pilot valve for a reciprocating function according to claim 8 wherein: said pneumatic piston is further provided with means for alternately effecting flow of pressure fluid from said constant source of pressure fluid to said major diameter end and to vent in response to mechanical shift of said pneumatic piston.

10. A mechanical shift pneumatic assisted pilot valve for a reciprocating function according to claim 9 wherein: said means for alternately effecting flow of pressure fluid from said constant source of pressure fluid to said major diameter end and to vent in response to mechanical shift of said pneumatic piston further comprises a valve on said pneumatic piston minor diameter and a passage interconnecting said valve and said major end of said pneumatic piston.

* * * * *